US006626661B1

(12) United States Patent
Zink et al.

(10) Patent No.: US 6,626,661 B1
(45) Date of Patent: Sep. 30, 2003

(54) FUEL EJECTOR AND METHOD FOR REDUCED $NO_X$ EMISSIONS

(75) Inventors: Darton J. Zink, Tulsa, OK (US); Rex K. Isaacs, Tulsa, OK (US); Tim Kirk, Morris, OK (US); John McDonald, Broken Arrow, OK (US); Cody L. Little, Coweta, OK (US)

(73) Assignee: Zeeco, Inc., Broken Arrow, OK (US)

( * ) Notice: Subject to any disclaimer, the term of this patent is extended or adjusted under 35 U.S.C. 154(b) by 11 days.

(21) Appl. No.: 10/004,055

(22) Filed: Nov. 1, 2001

(51) Int. Cl.[7] ..... F23C 5/00; F23L 7/00

(52) U.S. Cl. ..... 431/8; 431/116; 431/115; 431/9

(58) Field of Search ..... 431/115, 116, 431/9, 8, 12, 181, 284, 174, 285, 187, 278; 239/428.5, 589, 590, 590.3

(56) References Cited

U.S. PATENT DOCUMENTS 5,060,867 A * 10/1991 Luxton et al. ..... 431/9

* cited by examiner

*Primary Examiner*—James C. Yeung
(74) *Attorney, Agent, or Firm*—Fellers, Snider, Blankenship, Bailey & Tippens, P.C.

(57) ABSTRACT

An improvement for an ejector having at least one discharge port effective for delivering a flow of fuel into a heating system such that flue gas in the heating system is entrained in the flow of fuel. The improvement comprises the ejector having an aerodynamic shape effective for increasing entrainment of the flue gas in the flow of fuel at the region of discharge adjacent the discharge port.

32 Claims, 4 Drawing Sheets

FUEL EJECTOR AND METHOD FOR REDUCED $NO_X$ EMISSIONS

FIELD OF THE INVENTION

The present invention relates to fuel ejectors and fuel ejection methods for burners used in process heaters, boilers, and other fired heating or incineration systems. More particularly, but not by way of limitation, the present invention relates to fuel ejectors and fuel ejection methods effective for reducing $NO_x$ emissions.

BACKGROUND OF THE INVENTION

A need presently exists for more efficient and economical burner systems capable of significantly reducing $NO_x$ emissions from heaters, furnaces, boilers, and other fired heating or incineration systems. One approach employed heretofore has been to precondition the burner fuel by mixing substantially inert flue gases therewith. As used herein, the phrase "flue gas" refers to the gaseous combustion products produced by the fired heating system. Diluting the fuel with flue gas reduces $NO_x$ emissions primarily by lowering burner flame temperatures.

As will be understood by those skilled in the art, some prior burner systems employ "free jet" fuel ejectors for entraining 5 flue gas in and mixing the flue gas with at least a portion of the burner fuel. The phrase "free jet" refers to a jet flow of a first fluid (i.e., fuel) issuing from a nozzle into a second fluid (i.e., flue gas) which, compared to the jet flow, is more at rest. Free jet fuel ejectors are sometimes positioned for discharging at least a portion of the burner fuel such that, prior to combustion, the fuel stream must travel through the flue gas environment existing within the interior of the fired heating system.

A free jet ejector 10 of a type heretofore employed in some burner systems is depicted in FIGS. 1 and 2. Ejector 10 comprises: a fuel pipe 12 which extends into the interior 20 of the heating system through a furnace wall or other structure 11; an ejector tip or nozzle 15 secured on the distal end of fuel pipe 12; a flow cavity 17 within ejector tip 15 in fluid communication with the flow passageway of fuel pipe 12; and an ejector port 14 extending laterally from flow cavity 17 through the sidewall of ejector tip 15. The lateral cross section of burner tip 15 will typically have a round shape, as depicted in FIG. 2.

Ejector port 14 discharges a stream of fuel 16 toward a combustion zone (not shown) within the fired heating system. The fuel will typically be a fuel gas comprising natural gas or generally any other type of gas fuel or gas fuel blend employed in process heaters, furnaces, boilers, or other fired heating or incineration systems. The fuel stream 16 flows through and entrains flue gas present within the interior 20 of the fired heating system.

It is typically desired that as much flue gas as possible be entrained in and mixed with fuel stream 16 as it travels toward the combustion zone. However, such entrainment and conditioning must typically occur very quickly and over a relatively short distance.

Unfortunately, the fuel ejectors heretofore used in the art have not provided optimum or adequate flue gas entrainment in the fuel discharge region 18 immediately outside of the ejector port 14. Because of the shape of ejector tip 15, the furnace flue gas flowing into the ejector discharge region 18 must contact and interact with fuel stream 16 at a very abrupt angle (typically close to 90°). In addition, the flue gas 19 flowing into discharge region 18 around the exterior of ejector tip 15 must follow a very sharply curved flow path. As a result of these characteristics, eddies and currents are created in discharge region 18 which significantly reduce flue gas entrainment.

As will thus be apparent, a need exists for a fuel ejector which will provide significantly enhanced flue gas entrainment, particularly in the discharge region 18 of the fuel flow stream.

SUMMARY OF THE INVENTION

The present invention satisfies the needs and alleviates the problems discussed hereinabove. The present invention provides an improvement for an ejector having at least one port effective for delivering a flow of fuel into a heating system such that flue gas within the heating system is entrained in the flow of fuel. In one aspect, the inventive improvement comprises the ejector having an aerodynamic shape effective for increasing entrainment of the flue gas in the flow of fuel in the discharge region at the ejector port.

In another aspect, the inventive improvement comprises the cross-sectional shape of the ejector in a cross-sectional plane extending through the ejector port having: a discharge end wherein the port is provided; a major axis extending through the discharge end; a second end on the major axis opposite the discharge end; a total length along the major axis from the discharge end to the second end; and a maximum lateral width which is less than the total length. In addition, the lateral width of the cross-sectional shape preferably increases along the-major axis from the discharge end to the location of maximum lateral width.

In another aspect, the present invention provides a method of reducing $NO_x$ emissions from a heating system having flue gas therein. The inventive method comprises the step of ejecting a fuel into the heating system in free jet flow from at least one port of an ejector positioned in the heating system. The free jet flow has a region of discharge adjacent the port and the ejector has an aerodynamic shape effective for increasing entrainment of the flue gas in the free jet flow at the region of discharge.

In yet another aspect, the present invention provides a method of reducing $NO_x$ emissions from a heating system having a flue gas therein comprising the step of ejecting a fuel into the heating system in free jet flow from at least one port of an ejector positioned in the heating system. The cross-sectional shape of the ejector in a cross-sectional plane extending through the port includes: a discharge end wherein the port is provided; a major axis extending through the discharge end; a second end on the major axis opposite the discharge end; a total length along the major axis from the discharge end to the second end; and a maximum lateral width which is less than the total length. The maximum lateral width is located along the major axis at a location of maximum lateral width and the cross-sectional shape increases in lateral width from the discharge end to the location of maximum lateral width.

Further objects, features, and advantages of the present invention will be apparent to those skilled in the art upon examining the accompanying drawings and upon reading the following detailed description of the preferred embodiments.

DETAILED DESCRIPTION OF THE PREFERRED EMBODIMENTS

Before explaining the present invention in detail, it is to be understood that the invention is not limited in its application to the details of construction and arrangement of parts illustrated in the accompanying drawings. The invention is capable of other embodiments and of being practiced or carried out in a variety of ways. It is to be understood that the phraseology and terminology employed herein is for the purpose. of description and not of limitation.

Figure 2:
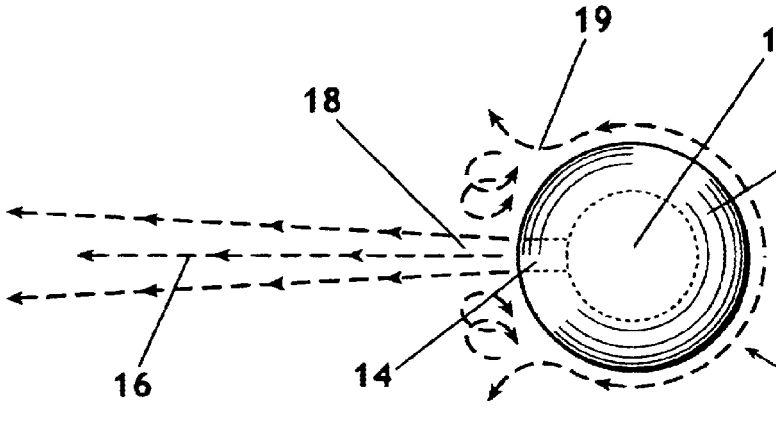
Fig. 2 ( PRIOR ART )
FIG. 2 provides a top view of prior art fuel ejector 10.
Figure 1:
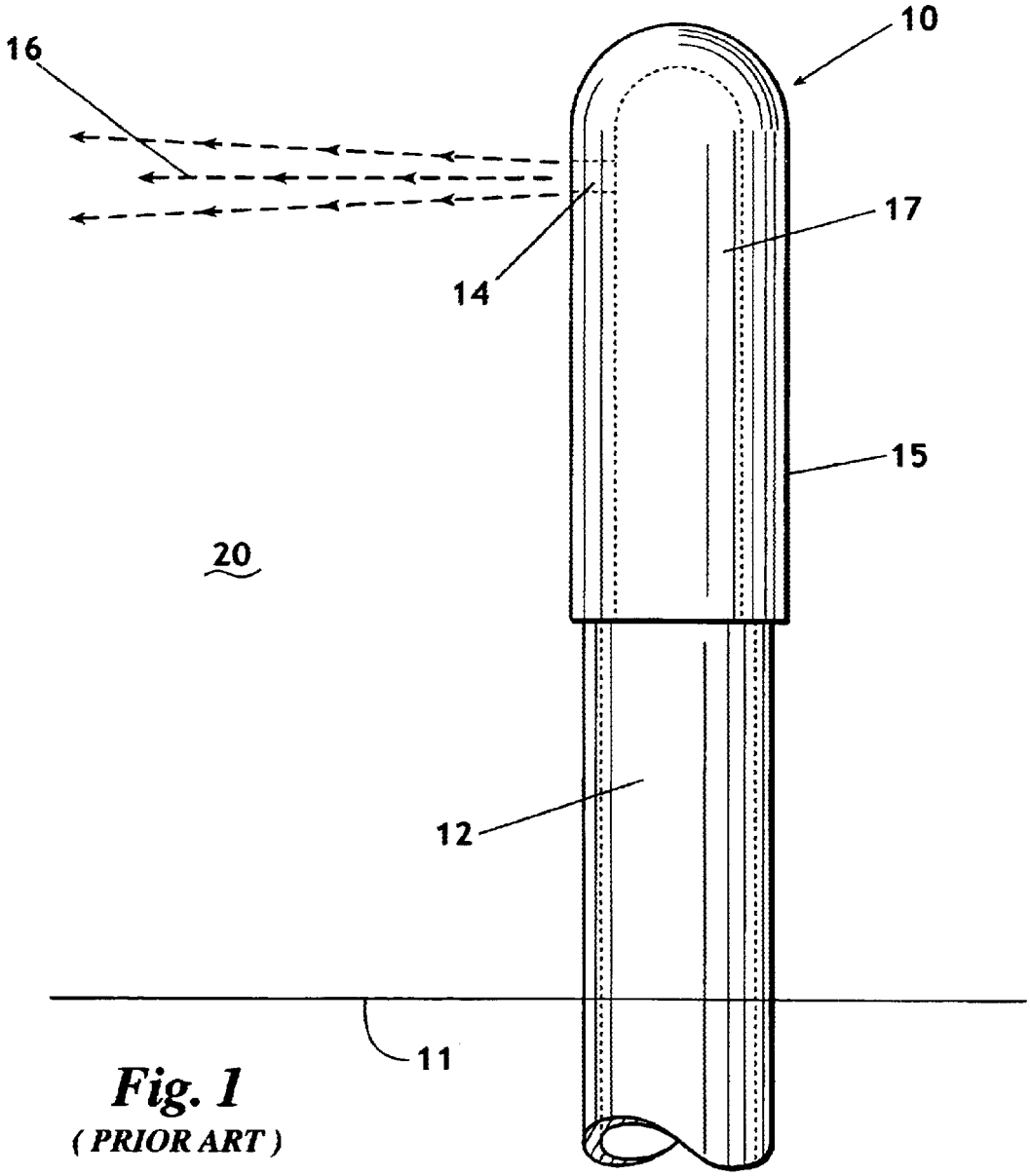
Fig. 1 ( PRIOR ART )
FIG. 1 provides an elevational side view of a prior art fuel ejector 10.
Figure 4:
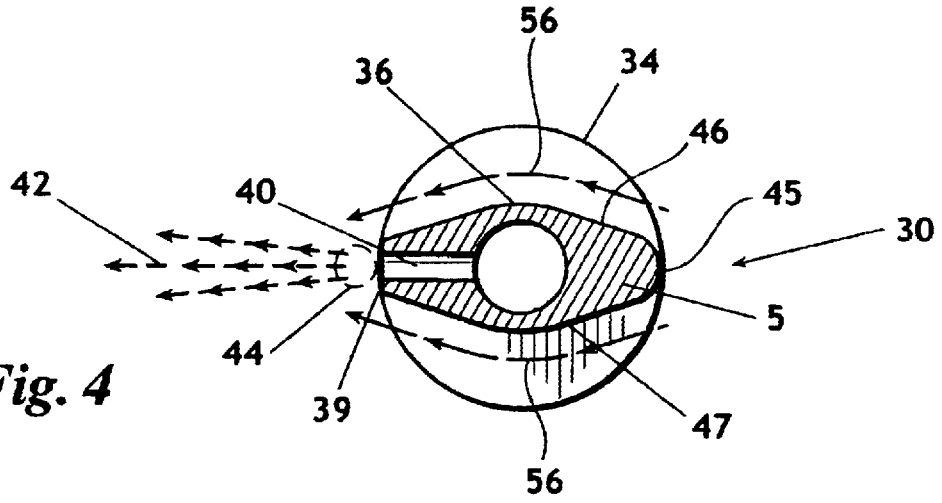
FIG. 4 provides a cutaway top view of inventive fuel ejector 30.
Figure 3:
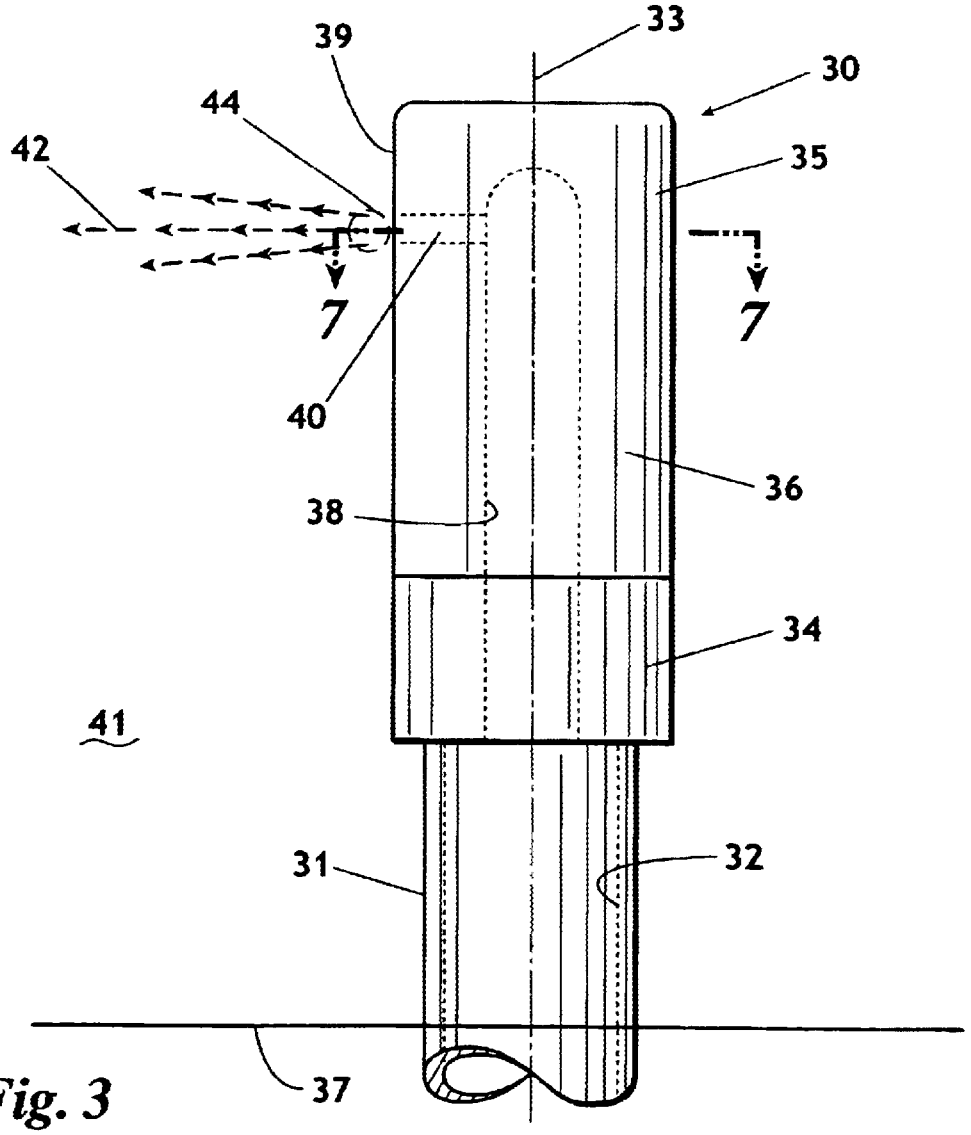
FIG. 3 provides an elevational side view of an embodiment 30 of the fuel ejector provided by the present invention.
Figure 7:
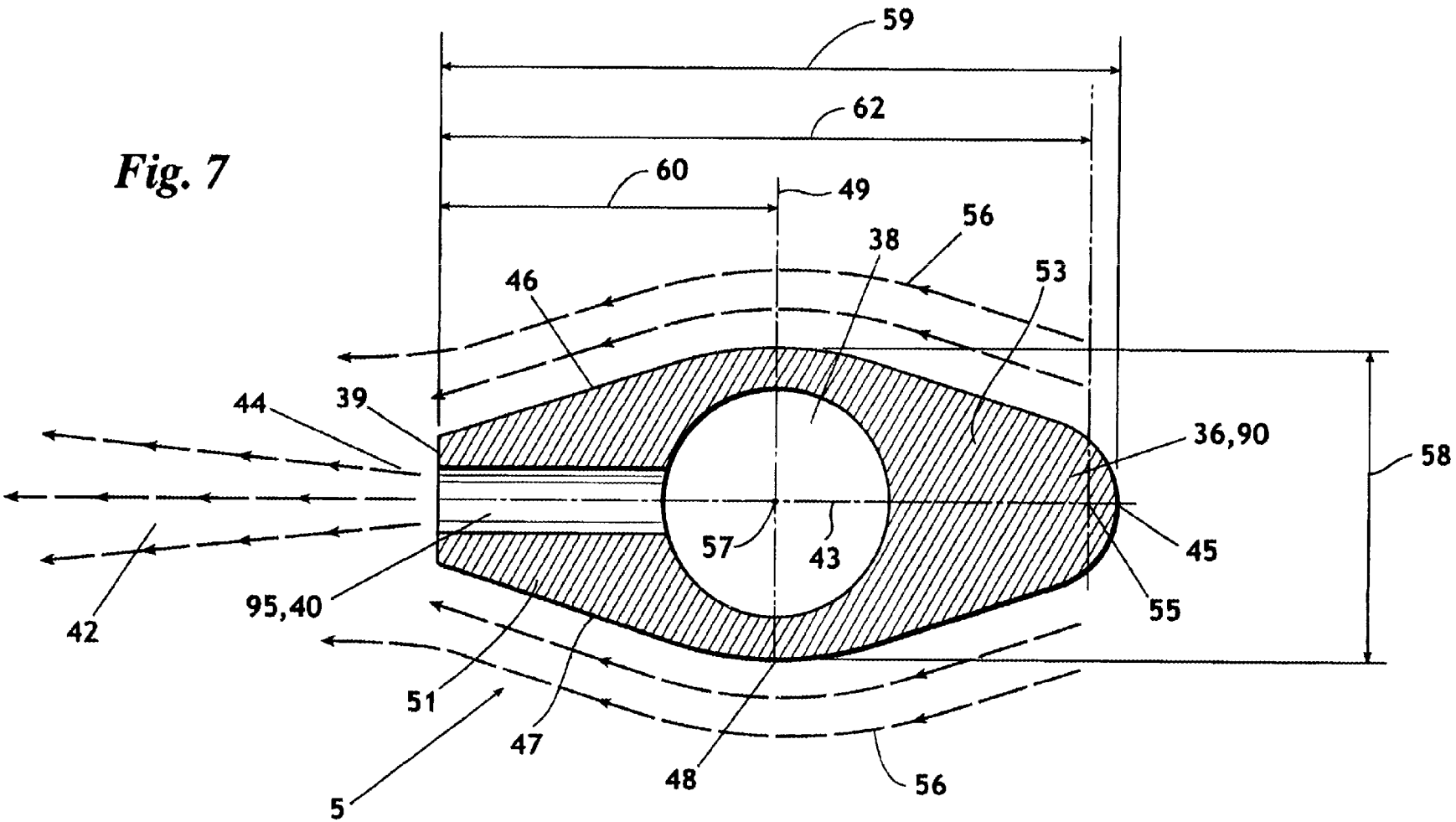
FIG. 7 provides a cutaway cross-sectional view of inventive fuel ejectors 30 and 80 as seen from perspective 7—7 shown in FIGS. 3 and 5.

An embodiment 30 of the inventive fuel ejector is depicted in FIGS. 3, 4, and 7. Inventive ejector 30 preferably comprises: a fuel pipe 31 having a flow passageway 32; an ejector tip or nozzle 36 positioned on the distal end of fuel pipe 31 and having an interior flow cavity 38 which is in fluid communication with the fuel pipe passageway 32; and at least one discharge port 40 extending laterally from the nozzle cavity 38 through the nozzle wall. The ejector tip 36 preferably comprises a lower portion 34 which is threadedly attached, welded, and/or otherwise secured to the distal end of fuel pipe 31.

Although inventive ejector 30 is depicted in FIG. 3 as being installed in a vertical position, it will be understood that inventive ejector 30 could be oriented horizontally or at any other angle. Inventive ejector 30 will typically be installed through, in, or in association with a heating system wall or other enclosure 37 such that a flow of fuel 42 is discharged from port(s) 40 through the flue gas contained within the interior 41 of the heating system. Although generally any type of fuel can be used, the fuel discharged from inventive ejector 30 will preferably be a fuel gas of the type used in furnaces, process heaters, boilers, and other types of fired heating and/or incineration systems.

The particular port(s) 40 employed in inventive ejector 30 can be of any shape(s) or structure(s) capable of providing the particular flow pattern and/or degree of flue gas entrainment and mixing desired. Examples of suitable shapes or structures include, but are not limited to: circles, ellipses, squares, rectangles, supersonic ejection orifices, etc. The port(s) 40 will preferably be shaped and/or configured to discharge the fuel stream 42 in free jet flow into the interior 41 of the heating system.

In a particularly preferred embodiment of the present invention, the discharge port(s) 40 will preferably be sized, shaped and/or configured to discharge fuel gas at a velocity in the range of from about 900 to about 1,500 feet per second and will most preferably be sized, shaped, and/or configured to discharge fuel gas at a velocity in the range of from about 1,100 to about 1,300 feet per second.

In accordance with the present invention, the discharge port(s) 40 of fuel ejector 30 is/are formed or otherwise provided in an aerodynamic upper portion 35 of the ejector tip or nozzle 36. The upper portion 35 of the inventive tip 36 extends from lower portion 34. The upper portion 35 can have any type of aerodynamic shape effective for increasing entrainment of flue gas in the discharge region 44 immediately outside of discharge port(s) 40. The aerodynamic shape of upper portion 35 will preferably be effective for (a) reducing the degree of curvature of the flue gas flow path 56 around the ejector tip 36 and (b) reducing or substantially eliminating the abrupt entry angle of this flue gas in the discharge region 44.

A preferred aerodynamic shape employed in embodiment 30 of the inventive ejector is depicted in FIG. 7. Specifically, FIG. 7 depicts a preferred cross-sectional shape 5 in the plane 7—7 (FIG. 3) which extends through the center of discharge port 40 and is perpendicular to the longitudinal axis 33 of ejector tip 36. The cross-sectional shape 5 comprises: a discharge end 39; a major axis 43; a second end 45 on major axis 43 opposite discharge end 39; an at least partially curved first side 46 extending from discharge end 39 to the second end 45 on one side of major axis 43; and an at least partially curved second side 47 extending from discharge end 39 to second end 45 on the opposite side of major axis 43.

The aerodynamic cross-section 5 of inventive ejector 30 is preferably symmetrical so that the curved second side 47 thereof is substantially a mirror image of the curved first side 46. The cross section thus also preferably includes a location (i.e., either a segment or a point, preferably a point) of maximum lateral width 48 located along major axis 43.

In preferred cross-section 5, the location of maximum lateral width is at point 57. Point 57 establishes the location of a lateral line 49 perpendicular to major axis 43. Lateral line 49 divides the cross-sectional shape 5 into a downstream portion 51 extending from lateral line 49 toward discharge end 39 and an upstream portion 53 extending from lateral line 49 toward the second end 45.

The aerodynamic cross-sectional shape 5 of inventive ejector 30 will preferably be such that the total length 59 of cross-section 5, as measured along major axis 43 from discharge end 39 to the opposite end 45, is greater than the maximum lateral width 58 thereof. The ratio of the maximum width 58 to the total length 59 will preferably be in the range of from about 0.3:1 to about 0.8:1 and will most preferably be in the range of from about 0.4:1 to about 0.7:1. In addition, the curvature of first side 46 and second side 47 will preferably be such that the lateral width of cross-section 5 (a) increases along major axis 43 from discharge end 39 to the location of maximum width 48 and (b) decreases along major axis 43 from the location of maximum width 48 to the opposite end 45.

As mentioned above, generally any aerodynamic shape effective for increasing entrainment and mixing in the discharge region 44 can be used. By way of example, but not by way of limitation, each of curved sides 46 and 47 could be in the shape of an upper surface of an airplane wing. Alternatively, or in addition, the downstream and upstream portions 51 and 53 of the ejector cross section could be in the form of partial parabolas, partial ellipses, or partial teardrop shapes. In each case, the dimensions of the downstream portion 51 and the upstream portion 53 could be either the same or different.

As depicted in FIG. 7, the upstream end 45 of the aerodynamic cross section will preferably be rounded. The discharge end 39, on the other hand, can be either flat or rounded but will preferably be at least substantially flat. If a flat discharge end 39 is used, the diameter of the discharge port(s) 40 preferably will not exceed the lateral width of discharge end 39. Thus, the use of multiple discharge ports 40 may be desirable where it is necessary or preferred to provide a high fuel discharge rate without using a single port of excessive diameter.

FIG. 7 further illustrates that the aerodynamic cross-section 5 will preferably include a point 55 in upstream portion 53 along major axis 43 wherein the lateral width of the upstream portion 53 is equal to the lateral width of discharge end 39. If the discharge end 39 is rounded rather than flat, the point of equivalent width 55 will be upstream end 45. However, if, as depicted in FIG. 7, the discharge end 39 is at least substantially flat, the point of equivalent width 55 will be spaced rearwardly of upstream end 45.

In a particularly preferred embodiment of inventive ejector 30, the downstream and upstream segments 51 and 53 of the aerodynamic cross section will preferably be proportioned such that the distance 60 from discharge end 39 to the point of maximum lateral width 48 is at least (and is preferably greater than) 50% of the length 62 from discharge end 39 to the point of equivalent lateral width 55. The length 60 of the downstream portion 51 will more preferably be in the range of from about 52% to about 65% of the distance 62 and will most preferably be in the range of from about 54% to about 60% of the distance 62.

As illustrated in FIGS. 4 and 7, the aerodynamic cross-sectional shape 5 of ejector 30 is particularly well suited for increasing flue gas entrainment in the fuel discharge region 44. In this regard, the aerodynamic shape 5 of inventive ejector 30 greatly reduces the curvature of the flue gas flow paths 56 around the exterior of the ejector. In addition, the aerodynamic shape greatly reduces the existence, severity, and deleterious effect of eddies, currents, and other anomalies around discharge region 44.

Figure 6:
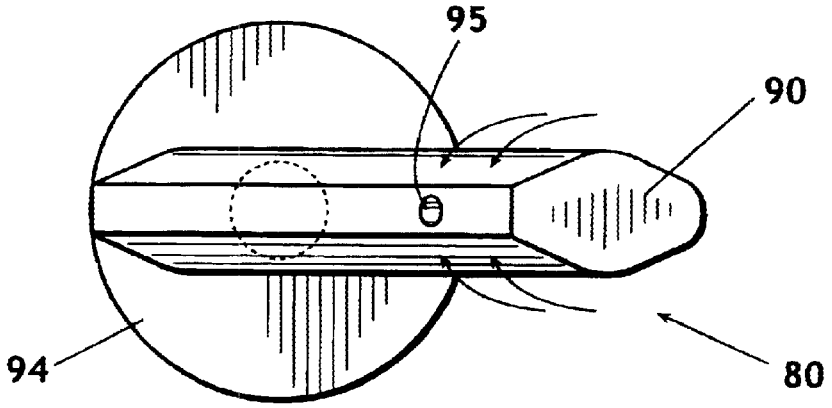
FIG. 6 provides a top view of inventive fuel ejector 80.
Figure 5:
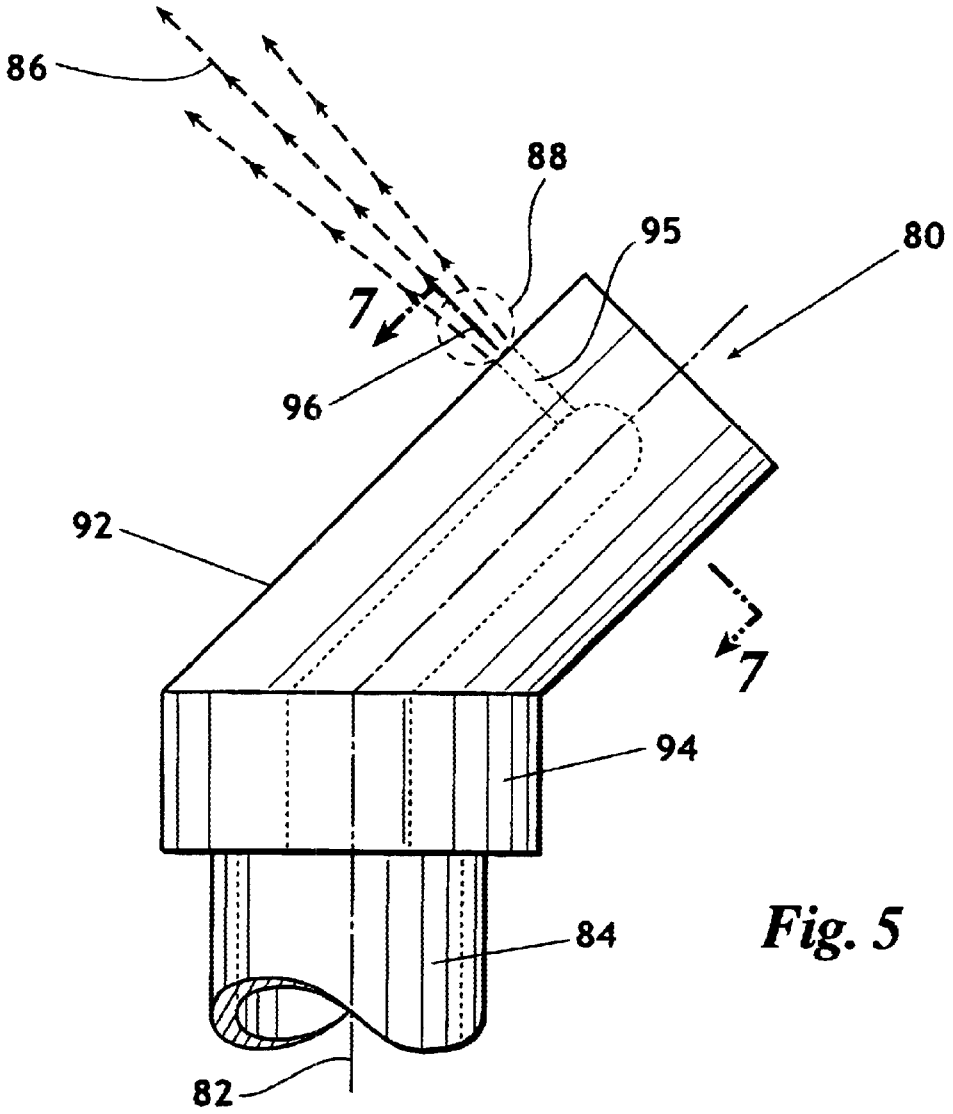
FIG. 5 provides an elevational side view of an alternative embodiment 80 of the inventive fuel ejector.

An alternative embodiment 80 of the inventive fuel ejector is depicted in FIGS. 5 and 6. Inventive ejector 80 is configured for discharging the fuel at an angle with respect to the centerline 82 of the fuel pipe 84. The use of the inventive alternative ejector 80 is particularly advantageous, for example, where it is desired to eject the fuel stream 86 at an angle toward a forwardly spaced burner wall or combustion zone. The beneficial effect achieved in the discharge region 88 of inventive ejector 80 is the same as that achieved in discharge region 44 of inventive ejector 30.

Embodiment 80 of the inventive ejector is substantially identical to inventive ejector 30 except that the upper or outer portion 90 of the ejector tip or nozzle 92 is at an angle with respect to fuel pipe 84 and with respect to the lower portion 94 of the ejector tip. Although any aerodynamic shape can be used, the cross section of inventive ejector 80 in the plane 7—7 extending through port 95 will preferably be the same as cross-section 5 shown in FIG. 7.

In a particularly preferred embodiment of inventive ejector 80, the upper portion 90 of ejector tip 92 is oriented such that the angle 96 of cross-section 7—7 with respect to the centerline 82 extending through fuel pipe 84 and lower portion 94 is in the range of from about 10 to about 60° and is more preferably in the range of from about 13 to about 50°.

As will be understood by those skilled in the art, the inventive improvement can be used for generally any type of fuel tip, fuel nozzle, or other fuel ejector. In addition, the inventive fuel ejector can be used alone or in combination with any number and type of other ejectors. Moreover, it will also be understood that the inventive ejector can be used for any type of free jet application and is not limited to fuel ejection.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. In an ejector having at least one port effective for delivering a flow of fuel into a heating system such that flue gas in said heating system is entrained in said flow of fuel, said flow of fuel having a region of discharge at said port, the improvement comprising said ejector having an aerodynamic shape effective for increasing entrainment of said flue gas in said flow of fuel at said region of discharge wherein, in a cross-sectional plane extending through said port, said aerodynamic shape comprises:

a discharge end wherein said port is provided;

a major axis extending through said discharge end;

a total length along said major axis; and a maximum lateral width which is less than said total length, wherein said maximum lateral width is located at a location of maximum lateral width along said major axis and wherein said aerodynamic shape increases in lateral width in said cross-sectional plane along said major axis from said discharge end to said location of maximum lateral width.

2. The ejector of claim 1 wherein said aerodynamic shape is symmetrical in said cross-sectional plane along said major axis.

3. The ejector of claim 2 wherein:

said aerodynamic shape has a first portion in said cross-sectional plane extending from said discharge end to said location of maximum lateral width;

said cross-sectional shape has a second end on said major axis opposite said discharge end;

said aerodynamic shape has a second portion in said cross-sectional plane extending from said location of maximum lateral width to said second end, said second portion decreasing in lateral width from said location of maximum lateral width to said second end;

said discharge end has a lateral width;

said second portion has a point of equivalent width along said major axis wherein said lateral width of said second portion is equivalent to said lateral width of said discharge end, said point of equivalent width being a distance from said discharge end; and said first portion has a length along said major axis from said discharge end to said location of maximum lateral width which is greater than one-half of said distance from said discharge end to said point of equivalent width.

4. The ejector of claim 3 wherein said length of said first portion along said major axis is in the range of from about 52% to about 65% of said distance from said discharge end to said point of equivalent width.

5. The ejector of claim 3 wherein said length of said first portion along said major axis is in the range of from about 54% to about 60% of said distance from said discharge end to said point of equivalent width.

6. The ejector of claim 2 wherein said aerodynamic shape in said cross-sectional plane further comprises:

a curved first outer side extending from said discharge end to said second end; and a curved second outer side, opposite said major axis from said first outer side, extending from said discharge end to said second end.

7. The ejector of claim 6 wherein said second end is rounded.

8. The ejector of claim 1 wherein the improvement further comprises said ejector having:

a first segment with a longitudinal axis and a second segment extending from said first segment and including said port, wherein said second segment is angled with respect to said first segment.

9. The ejector of claim 8 wherein said cross-sectional plane intersects said longitudinal axis at an angle in the range of from about 10° to about 60°.

10. The ejector of claim 8 wherein said cross-sectional plane intersects said longitudinal axis at an angle in the range of from about 13° to about 50°.

11. The ejector of claim 1 having a ratio of said maximum lateral width to said total length in the range of from about 0.3:1 to about 0.8:1.

12. The ejector of claim 1 having a ratio of said maximum lateral width to said total length in the range of from about 0.4:1 to about 0.7:1.

13. In an ejector having at least one port effective for delivering a flow of fuel into a heating system such that flue gas in said heating system is entrained in said flow of fuel, the improvement comprising said ejector having a cross-sectional shape in a cross-sectional plane extending through said port including:

a discharge end wherein said port is provided;

a major axis extending through said discharge end;

a second end on said major axis opposite said discharge end;

a total length along said major axis from said discharge end to said second end; and a maximum lateral width which is less than said total length, said maximum lateral width being located along said major axis at a location of maximum lateral width, and said cross-sectional shape increasing in lateral width from said discharge end to said location of maximum lateral width.

14. The ejector of claim 13 having a ratio of said maximum lateral width to said total length in the range of from about 0.3:1 to about 0.8:1.

15. The ejector of claim 13 having a ratio of said maximum lateral width to said total length in the range of from about 0.4:1 to about 0.7:1.

16. The ejector of claim 13 wherein said cross-sectional shape further includes:

a curved first outer side extending from said discharge end to said second end and a curved second outer side extending from said discharge end to said second end, said curved second outer side being opposite said major axis from said curved first outer side.

17. The ejector of claim 16 wherein said cross-sectional shape is symmetrical along said major axis.

18. The ejector of claim 13 wherein:

said cross-sectional shape has a first portion extending from said discharge end to said location of maximum lateral width;

said cross-sectional shape has a second portion extending from said location of maximum lateral width to said second end;

said second portion decreases in lateral width from said location of maximum lateral width to said second end;

said discharge end has a lateral width;

said second portion has a point of equivalent width along said major axis wherein said lateral width of said second portion is equivalent to said lateral width of said discharge end, said point of equivalent width being a distance from said discharge end; and said first portion has a length along said major axis from said discharge end to said location of maximum lateral width which is greater than one-half of said distance from said discharge end to said point of equivalent width.

19. The ejector of claim 18 wherein said length of said first portion along said major axis is in the range of from about 52% to about 65% of said distance from said discharge end to said point of equivalent width.

20. The ejector of claim 18 wherein said length of said first portion along said major axis is in the range of from about 54% to about 60% of said distance from said discharge end to said point of equivalent width.

21. The ejector of claim 13 wherein the improvement further comprises said ejector having:

a first segment with a longitudinal axis and a second segment extending from said first segment and including said port, wherein said second segment is angled with respect to said first segment.

22. The ejector of claim 21 wherein said cross-sectional plane intersects said longitudinal axis at an angle in the range of from about 10° to about 60°.

23. The ejector of claim 21 wherein said cross-sectional plane intersects said longitudinal axis at an angle in the range of from about 13° to about 50°.

24. A method of reducing $NO_x$ emissions from a heating system having flue gas therein comprising the step of ejecting a fuel into said heating system in free jet flow from at least one port of an ejector positioned in said heating system, wherein said ejector has a cross-sectional shape in a cross-sectional plane extending through said port including:

a discharge end wherein said port is provided;

a major axis extending through said discharge end;

a second end on said major axis opposite said discharge end;

a total length along said major axis from said discharge end to said second end; and a maximum lateral width which is less than said total length, said maximum lateral width being located along said major axis at a location of maximum lateral width, and said cross-sectional shape increasing in lateral width from said discharge end to said location of maximum lateral width.

25. The method of claim 24 wherein said ejector has a ratio of said maximum lateral width to said total length in the range of from about 0.3:1 to about 0.8:1.

26. The method of claim 24 wherein said ejector has a ratio of said maximum lateral width to said total length in the range of from about 0.4:1 to about 0.7:1.

27. The method of claim 24 wherein said cross-sectional shape further includes:

a curved first outer side extending from said discharge end to said second end and a curved second outer side extending from said discharge end to said second end, said curved second outer side being opposite said major axis from said curved first outer side.

28. The method of claim 27 wherein said cross-sectional shape is symmetrical along said major axis.

29. The method of claim 24 wherein:

said cross-sectional shape has a first portion extending from said discharge end to said location of maximum lateral width;

said cross-sectional shape has a second portion extending from said location of maximum lateral width to said second end;

said second portion decreases in lateral width from said location of maximum lateral width to said second end;

said discharge end has a lateral width;

said second portion has a point of equivalent width along said major axis wherein said lateral width of said second portion is equivalent to said lateral width of said discharge end, said point of equivalent width being a distance from said discharge end; and said first portion has a length along said major axis from said discharge end to said location of maximum lateral width which is greater than one-half of said distance from said discharge end to said point of equivalent width.

30. The method of claim 29 wherein said length of said first portion along said major axis is in the range of from about 52% to about 65% of said distance from said discharge end to said point of equivalent width.

31. The method of claim 29 wherein said length of said first portion along said major axis is in the range of from about 54% to about 60% of said distance from said discharge end to said point of equivalent width.

32. The method of claim 24 wherein:

said ejector has a first segment with a longitudinal axis;

said ejector has a second segment extending from said first segment and including said port; and said second segment is angled with respect to said first segment such that said cross-sectional plane intersects said longitudinal axis at an angle in the range of from about 10° to about 60°.

* * * * *